US006422574B1

(12) United States Patent
Mooklar

(10) Patent No.: US 6,422,574 B1
(45) Date of Patent: Jul. 23, 2002

(54) WATER SEAL FOR QUICK REPAIR AND FLOW CONTROL

(76) Inventor: Charles J. Mooklar, 2360 Calle MImosa, Thousand Oaks, CA (US) 91360

( * ) Notice: Subject to any disclaimer, the term of this patent is extended or adjusted under 35 U.S.C. 154(b) by 0 days.

(21) Appl. No.: 09/568,337

(22) Filed: May 10, 2000

(51) Int. Cl.[7] ..... F16L 17/06

(52) U.S. Cl. ..... 277/608; 277/614; 277/616; 277/620; 285/31

(58) Field of Search ..... 277/608, 614, 277/616, 619, 620, 624; 285/31

(56) References Cited

U.S. PATENT DOCUMENTS 3,603,618 A 9/1971 Stratton
4,234,198 A 11/1980 Martin et al.
4,400,018 A 8/1983 Abbes et al.
4,417,735 A 11/1983 Heisler
5,975,587 A * 11/1999 Wood et al. ..... 285/31 X
6,139,026 A * 10/2000 Gruver, III et al.
6,234,545 B1 * 5/2001 Babuder et al. ..... 277/608 X

* cited by examiner

*Primary Examiner*—Robert J. Sandy
*Assistant Examiner*—Karlena D. Schwing

(57) ABSTRACT

This invention relates to a more serviceable seal assembly of the above type, particularly adapted for applications in the cooling systems of internal combustion engines. The seal assembly of this invention comprises an annular ferrule, an elastomeric seal circunferentially disposed thereabout, a pair of annular mounting rings and a clamping device. Tightening of the clamp expands the elastomeric seal outward against the annular mounting rings which are statically sealed within the members of the engine. Selective sizing of the annular mounting rings can be used to control coolant flow. The use of this seal assembly does not require the removal and replacement of members of the engine for installation or servicing.

6 Claims, 3 Drawing Sheets

WATER SEAL FOR QUICK REPAIR AND FLOW CONTROL

BACKGROUND OF THE INVENTION

This invention relates to a seal assembly disposed between and within two stationary members employed on an engine and having a common passageway formed therein to communicate coolant therethrough.

Cooling systems as used upon internal combustion engines have ,several passages for coolant flow. Often some of the passages cannot be efficiently contained completely within the major members that make up the engine, such as the block, cylinder heads, front cover assembly, and manifolds, and must be routed externally. These external passages usually consist of hoses, single piece tube assemblies with O-rings or other seals, press in rubber seals, expandable rubber seals, and other devices which form a static seal between adjacent members of an engine. An additional function of some sealing apparatus that form a passage is introducing a restriction in a coolant passage to control flow. Nearly all engines that use liquid for cooling purposes require a device or selection of passage sizing which restricts the flow of coolant to avoid overcooling or reduce cavitation. Selective sizing of the of the seal's bore will influence the volume of coolant which may pass through it and the adjoining member.

When engines are originally manufactured, their design is put forth which anticipates the use of one or more of the seal types mentioned above. Few different designs, if any, are interchangeable with each other during assembly, maintenance, or repair of an engine. Thus, particularly in the case of a single piece tubular device with O-ring seals, if leakage occurs. at least one of the major engine members must be removed and replaced upon the engine in order to replace the tube or O-ring seals. Even though the original tubular units can be cut or broken out of their original position, available replacement parts duplicate the original single piece design and require removal and replacement of one or more major engine members.

Although several types of water seals exist for various purposes, none are able to efficiently and directly replace the above mentioned single piece tubular design which seals and is positioned within existing coolant passage bores in the adjacent engine members.

Two prior designs are U.S. Pat. No. 3,603,618 to Stratton (1971) and an improvement on same, U.S. Pat. No. 4,234,198 to Marten, Smith (1980) both disclose a single elastomeric seal with ferrule assembly which seals directly upon the face of the members. Both designs have an inside diameter which is as large or larger than the bore of the passage within the members which they form a passage with. These designs require a means external of the coolant passages fbr mounting and alignment. As mentioned in their description and claims, both of these seal designs utilize notches, annular cut-outs, grooves, or bosses, for alignment and mounting purposes, which require original engine manufacturing that anticipates their use. Since both of these prior designs seal directly against the face of the engine members, it is required that there be a substantial radially flat area machined upon the face of each member of the engine to provide an accommodating surface for the elastomeric seal. Another deficiency in these designs is that the elastomeric seal does not have sufficient volume of resilient material to maintain outwardly pressure and static seal over an extended time period. This weakness is due to heating and cooling cycles common with internal combustion engines, which tend to stiffen and eventually cause slight shrinkage to these types of material. Evidence of this is U.S. Pat. No. 4,234,198, as identified above, which attempts to add resilient material and increase the clamping forces. Mounting and space limitations limit the range, usefulness, and reliability of these prior designs. These prior designs would be prohibited where there are substantial contours, space limitations, or lack of a substantially flat machined surface on the radially extending face surrounding the coolant passages of each adjacent member of the engine.

Another prior design, U.S. Pat. No. 4,400,018 to Abbes, Rouaud, Forges, and de Villepoix (1983) discloses a seal assembly for joining two opposing pipe ends. The inside diameter of the seal assembly is as large or larger than the bore of the pipes that it connects. The two opposing flanges are flat except for a cradle for the extensible member to reside upon. The two opposing flanges must also be welded onto the end of each pipe. O-rings are used between the face of each flange and the extensible members. The assembly requires two separate extensible members with conical shaped faces. A two piece moveable member, with a double conical shape is wedged in between the extensible members and presses against the latter mentioned conical faces. The moveable member also bears against the rear faces of the radial flanges to prevent the pipes from moving apart. No part of this invention resides within the passages of the members or in this case pipes. Mounting relies on the front and back sides of external, flat, welded on flanges. All sealing is accomplished with two separate O-rings which each seal against three surfaces. The internal diameter of the tubular member is substantially the same diameter as the corresponding pipes. This seal assembly requires a multiple of flat radial surfaces for mounting means. The extensible members are of rigid material and do not serve to form the seal between the pipes. Sealing is accomplished by pressure exerted upon the. O-rings by the extensible member to form sealing contact between the flanges and the tubular member. It would be nearly impossible to utilize this seal assembly between rigidly mounted members of an engine which do not have several inches of space between them and which do not have a tubular projection with flanges incorporated upon them during their manufacture.

Another prior art example is U.S. Pat. No. 4,417,735 to Heisler (1983) reveals a sealing device disposed between adjacent members of an engine. This design also has an inside diameter as large or larger than the bore of the passage in the members which it seals. A centering bead exists on one of the members to provide a means of locating the seal assembly. Clamping upon a trapezoidal shape is used to cause expansion outwardly against the members. This is, a rigid design with resilient material being used only in the form of gasketing applied to the outer surfaces. The sealing and mounting of this seal assembly is completely dependant on the protruding surfaces of the members being precisely machined to form a corresponding mechanical fit. This design allows a component such as a manifold to be removed without disturbing other members. However it does not allow for the seal itself to be installed or removed alone. The seal assembly must be placed upon one of the engine components while one of the component is being installed. Again, for reasons similar to those mentioned above, this seal assembly would be nearly impossible to use between rigidly mounted adjacent members of an engine.

None of these prior art examples are capable of mounting within the bore of existing passages, or have any provisions for control of coolant flow. Further, none are capable of sealing where there are no special machined surfaces or other devices provided upon the face of each adjacent member.

BRIEF SUMMARY OF THE INVENTION

An object of this invention is to provide a more serviceable seal assembly of the above type, particularly adapted for applications in the cooling system of internal combustion engines. The seal assembly comprises an annular ferrule, an elastomeric seal circumferentially disposed thereabout and a pair of annular mounting rings. The annular mounting rings provide a radial surface to engage with the elastomeric seal and also extend into and seal within the coolant passage bore of each adjacent member. A clamping means circumferentially surrounds the seal and ferrule to apply a clamping force radially inwardly on the seal to expand the sidewalls thereof into sealing contact with the annular mounting rings. The annular mounting rings may also provide for control of coolant flow by selection of bore sizing.

OBJECTS AND ADVANTAGES

Accordingly, several objects and advantages of the present invention are;

a) to provide a seal assembly which can easily be installed without removing any major engine members such as a cylinder head or front cover assembly;

b) to provide a seal assembly which can easily be installed by hand without any additional machining, welding or fabrication;

c) to provide a seal assembly which mounts and seals within opposing passages employed on members of an engine and which are separated from each other by a gap which is at least wide enough to install the various parts of the invention;

d) to provide a seal assembly which utilizes existing bores within the members to provide all necessary mounting and alignment of the various parts of the seal assembly;

e) to provide a seal assembly with a low overall profile which is tolerant of substantial contours, space limitations, or lack of a substantial radially flat area, which may be on or near the face of one or both adjacent members of the engine;

f) to provide a seal assembly which can be more easily serviced when necessary to repair leaks or perform other maintenance;

g) to provide a seal assembly which by it's construction is mostly reusable;

h) to provide a seal assembly which by selective sizing of it's bore can be used to control the volume of coolant flow;

i) to provide a seal assembly which no longer causes many other engine parts such as gaskets, seals, coolant, oil and filters, and other used but serviceable parts, which may not be at the end of their useful service life, to be replaced prematurely;

j) to provide a seal assembly which is at least as reliable as prior art and has sufficient volume and shape of resilient material to withstand aging which is inherent with the frequent heating and cooling cycles common to internal combustion engines, thus not needing periodic adjusting of the clamping means or other undesirable maintenance.

Further objects and advantages are to provide a seal assembly which can be utilized nearly anytime or anywhere an engine may be, including when a leak occurs on-the-job, avoiding the need for towing or more expensive damage and repairs due to loss of coolant. Still further objects and advantages will become apparent from a consideration of the ensuing description and drawings.

REFERENCE NUMERALS

| | |
|---|---|
| 3 elastomeric seal | 4 O-ring |
| 5 annular mounting ring | 6 clamp |
| 7 ferrule | 8 coolant passage |
| 9 outwardly flange | 10 flexible strap |
| 11 member | 12 seal bore |
| 13 step | 14 slots |
| 15 step | 16 inwardly flange |
| 17 screw | 18 O-ring groove |
| 19 outwardly face | 20 inwardly face |
| 21 seal assembly | |

DETAILED DESCRIPTION OF THE INVENTION

Figure 1:
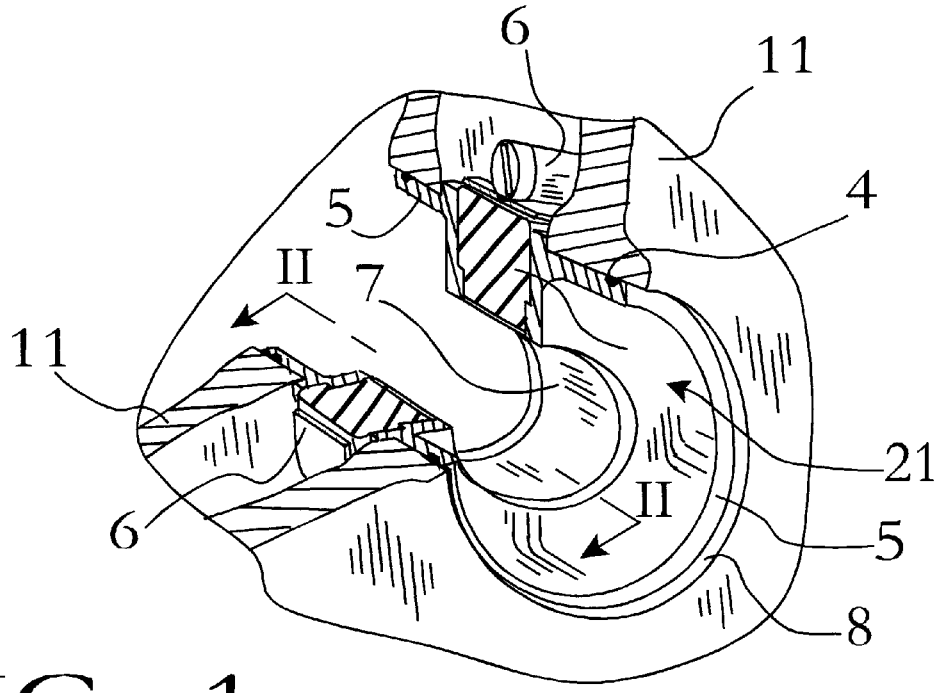
FIG. 1 is a sectioned isometric view of a seal assembly embodying this invention, shown disposed between a pair of adjacent members to form a static seal within a common passageway formed therein.

FIG. 1 illustrates a seal assembly 21 disposed between a pair of adjacent members 11, such as a cylinder head and front cover employed on an internal combustion engine. A common passageway 8 is formed in the members to communicate fluid therebetween, such as water or oil. As will be hereinafter fully described, the seal assembly comprises a pair of anmular mounting rings 5 installed and sealing within the members. An elastomeric seal 3 is placed ard expanded into sealing contact between the annular adapters to provide a static seal therein to prevent the egress of fluid thereby from passageway 8.

Figure 3:
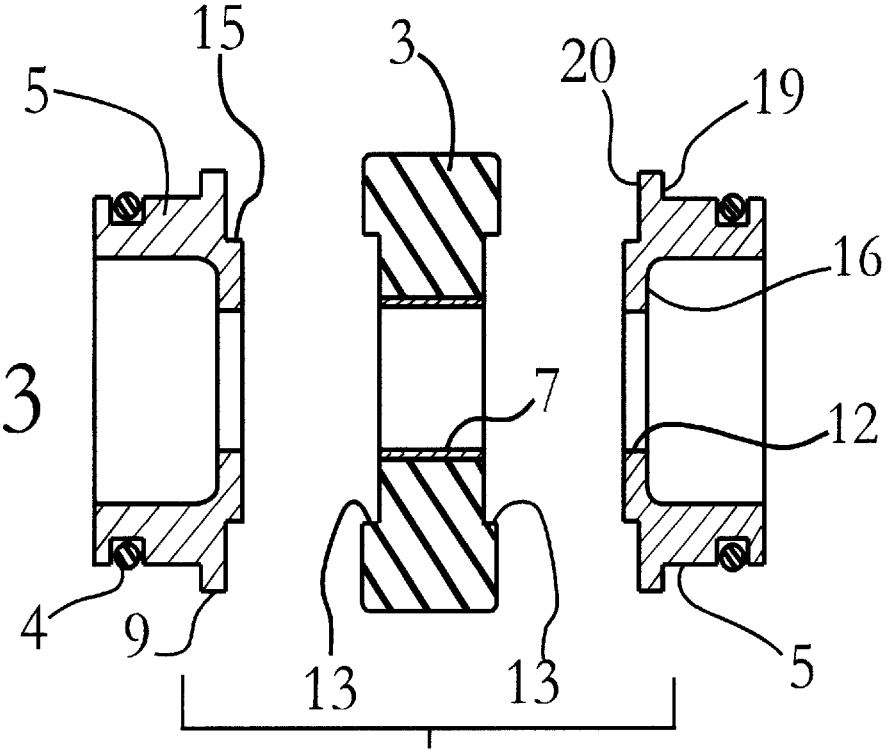
FIG. 3 is a cross section exploded view of the parts of the seal, shown in the direction of arrows II—II in FIGS. 1 and 2, but not including the clamp which is of standard design.
Figure 4:
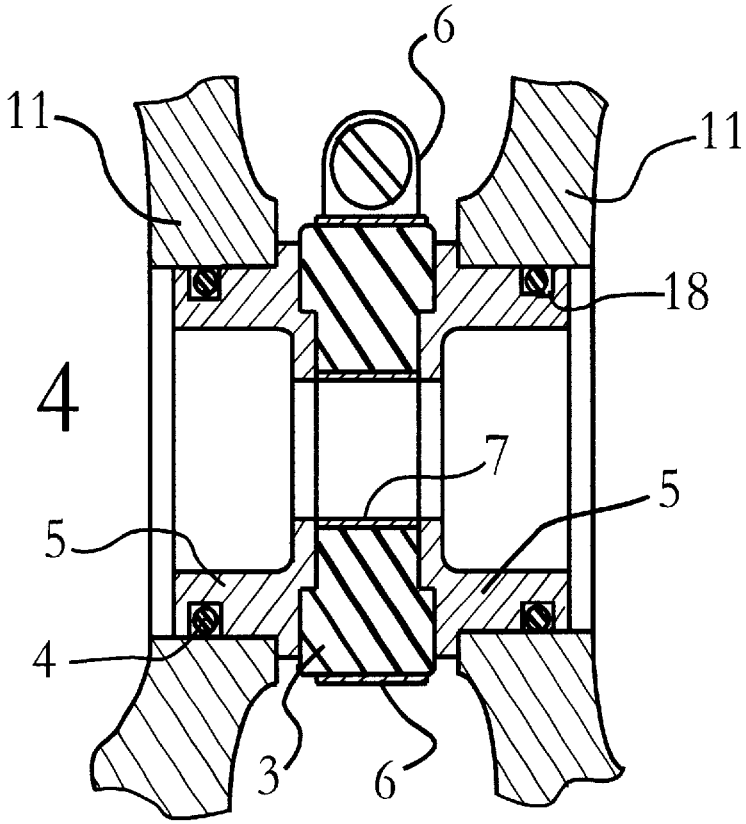
FIG. 4 is a cross section view illustrating the seal assembly, shown in the direction of arrows II—II in FIGS. 1 and 2 in it's installed condition between a pair of adjacent members to form a static seal within a common passageway formed therein.

Referring to FIGS. 1 and 4, the seal assembly comprises an annular ferrule 7 having an elastomeric seal 3 circumferentially disposed thereabout, a pair of annular mounting rings 5 disposed generally within the stationary members 11. As shown in FIG. 4, a static seal is formed within each member and the corresponding end of each annular mounting ring by an O-ring seal 4 circumferentially disposed thereabout within a corresponding circumferential groove 18. However, it should be understood that the location of the O-ring and means other than an O-ring may be used to form a static seal between the annular mounting ring and the member, as is well known by those skilled in the arts relating hereto. As shown in FIG. 3, each annular mounting ring has on it's other end an integral radial flange 16 extending generally inwardly from the annulus. The outwardly face of said inwardly flange provides an area for the elastomeric seal to press and seal against. In applications where control of coolant flow is desired, the inwardly extending flange of each annular mounting ring has a bore 12 which can be selectively sized based on cooling system requirements. The overall length of each annular mounting ring must be less than the gap existing between the stationary members to facilitate installation without removal of either member. The inside diameter of the ferrule 7 is substantially the same as the bore 12 of the annular mounting rings.

Figure 5:
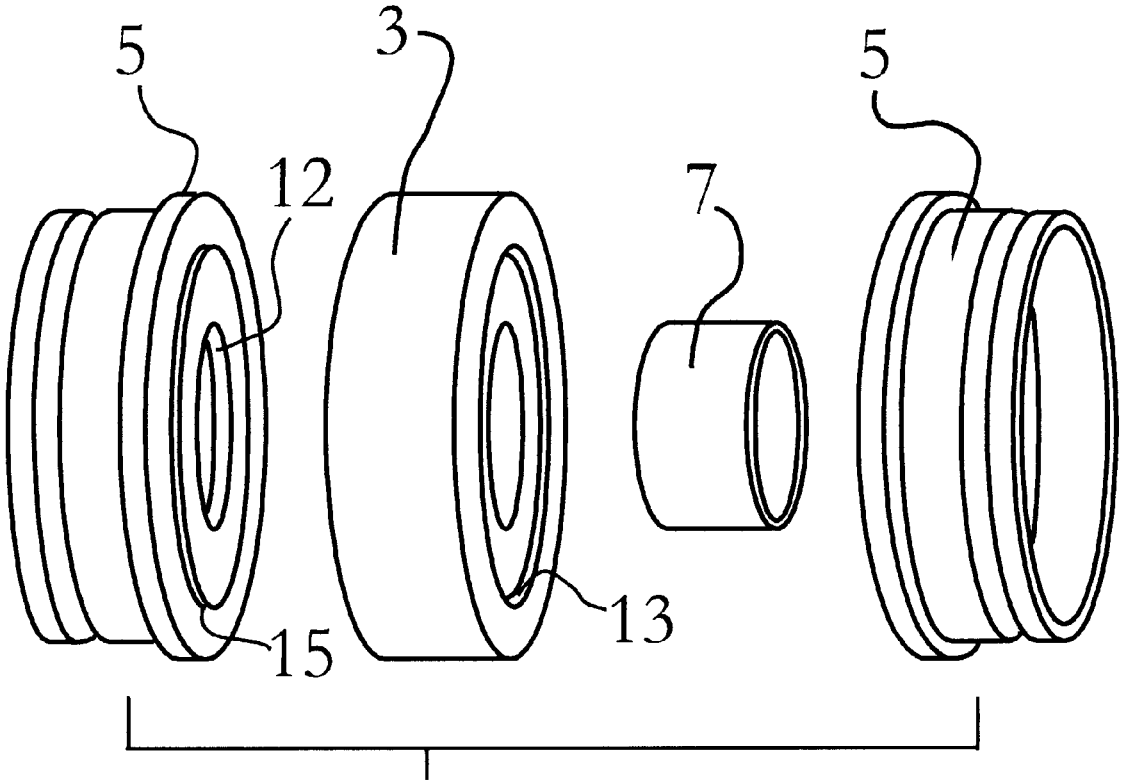
FIG. 5 is an expanded view showing the various parts of the seal assembly, but not showing the clamp and O-rings which are of standard design.

As shown in FIGS. 3 and 5, preformed into each sidewall of the elastomeric seal 3 and outwardly face of the inwardly flange of the annular mounting rings 5 is a contour in the form of a step 13 and 15. The step can be defined generally by two different overall cross sectional widths of the elastomeric seal and the radial flange of the annular mounting rings. The step upon each face of the elastomeric seal corresponds with a like but directionally opposite step disposed upon the face of the radial flange of each annular mounting ring to provide a means for alignment. It is desirable for the height of each step disposed upon all described faces be equal to between 5% and 20% of the cross sectional thickness of the elastomeric seal with such height approximating 8%. The preferred diameter of the step 15 as viewed upon the face of the elastomeric seal and radial flange of the annular adapter rings is between 5% and 100% of overall face diameter with such diameter approximating 70%. However it should be understood that any combination of diameter or height of the step, or that nearly any corresponding surface variation may be used for alignment purposes as is well known by those skilled in the arts relating hereto.

As shown in FIG. 3, the radial flange 16 of the annular mounting ring 5 viewed in cross section extends mostly radially inwardly from the annulus for the purpose described above. Each annular mounting ring also has a flange 9 extending radially outwardly a short distance. Flange 9 comprises an outwardly face 20 which provides additional area for the elastomeric seal. Said flange also comprises a inwardly face 19 which provides a means to limit the adapter's installed depth into the member. In so doing, outwardly flange serves to counteract the pressure exerted by the elastomeric seal. As shown in all figures, both inwardly and outwardly radially extending flanges upon each annular mounting ring share a generally common radial plane. However it should be understood that other means to limit the depth of insertion of the annular mounting ring into the member may cause the outwardly flange to be on a different plane than that mentioned above or not exist at all as is well known by those skilled in the arts relating hereto.

Figure 2:
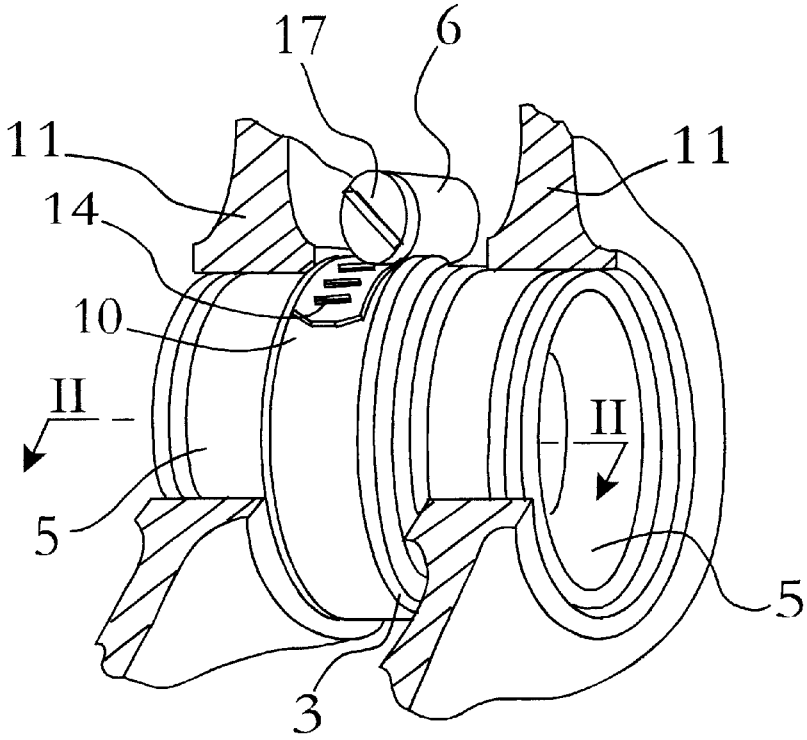
FIG. 2 is a view similar to FIG. 1, but illustrating the seal assembly in it's installed condition shown within and between sectioned members.

As shown in FIGS. 1 and 4 a clamping means 6 circumferentially surrounds the elastomeric seal 3 for applying a clamping force radially inward on the outer surface of the seal to expand the sidewalls thereof into sealing contact with the annular mounting rings 5. The clamping means may be of standard design as shown in FIG. 2 comprising a flexible strap 10 having a plurality of slots 14 formed therein to engage the spiraled threads (not shown) of a screw 17. Thus, selective rotation of the screw in either direction will either contract or expand the strap 10 in a conventional manner.

As further shown in FIGS. 1 and 4, installation of the elastomeric seal 3 and tightening of the clamping means 6 serves to hold the annular mounting rings tightly into the confines of the adjacent members and also serves to form a continuous conduit and static seal therewith.

The elastomeric seal 3 is preferably composed of a resilient material such as suitably composed rubber based material which will exert the desired sealing forces between parts 5. However it should be understood that other elastomeric materials may be used for the seal as is well known by those skilled in the arts relating hereto. Ferrule 7 and the annular mounting rings 5 may be composed of brass, composite, or like material which is non-corrosive when subjected to coolants such as water and strong enough to counteract the pressure from the elastomeric seal. The clamping means may be of standard composition which consists of stainless steel.

DESCRIPTION OF THE PREFERRED EMBODIMENT

Operation and use of the seal assembly is simple and straight forward. The old seal assembly, which the invention is intended to replace, resides in an exposed area between two major engine members. After a portion of the engine coolant has been drained the old seal assembly is removed by cutting it with a small hand or power activated saw to form shorter pieces which can be slid out from the bore of the coolant passage 8. After removing the pieces, the bores which held the old seal are cleaned of rust and scale usually by sanding or scraping.

An O-ring 4 is placed in a locating grove 18 on each annular mounting ring 5. After applying a suitable lubricant, each annular mounting ring with the accompanying O-ring is slid into the bore of the coolant passage 8 of the adjacent engine members 11. The support ferrule 7 is placed inside the elastomeric seal 3 and the clamp 6 is placed around the outside. This assembly is then inserted into a centered position between the annular mounting rings. The clamp is then tightened. This completes the installation of the invention. The job is complete when coolant is replaced back into the engine and a final check is made for any leaks.

CONCLUSIONS, RAMIFICATIONS, AND SCOPE

Accordingly, it can be seen that a seal assembly that can be installed without removal of any major engine members will save a great amount of mechanic's time, equipment down time, and money, when a leak in this area must be repaired. This is brought about by my invention which is at least as reliable as the original equipment seal, fits into existing bores within the coolant passages of two adjacent members, and into an area between the members which have no provisions manufactured onto their outer surface to accommodate other seal types. Because of the profile and nature of mounting, this new seal easily lends itself to applications where control of coolant flow is necessary.

Although the description above contains many specificities, these should not be construed as limiting the scope of the invention but as merely providing illustrations of some of the presently preferred embodiments of this invention. Various other embodiments and ramifications are possible within it's scope. For example, this invention would be well suited for sealing of opposing pipes, which are otherwise held in place, making a section or sections removable. Likewise, other uses could include a sealed passage between liquid or gas filled vessels or other compartments. This seal design is also capable of working with low to moderate pressures without the use of any circumferential clamping means by proper sizing of the elastomeric seal. Further uses, include a fixed outer ring in place of the clamping means and static sealing arranged by mechanical pressure exerted by the members upon the annular mounting rings to form sealing contact with the elastomeric seal. Thus the scope of the invention should be determined by the appended claims and their legal equivalents, rather than by the examples given.

What I claim as my invention is:

1. A seal assembly comprising:

(a) a circumferentially uninterrupted annular ferrule formed as a rigid, one piece construction, said ferrule having an inner diameter and an outer diameter, (b) a circumferentially uninterrupted annular elastomeric seal surrounding said ferrule, (c) a pair of annular mounting rings each formed as a rigid one piece construction comprising an open ended tubular section having an inner diameter and an outer diameter, said outer diameter having an uninterrupted circumferential groove, an uninterrupted circumferential elastomeric seal installed into said groove, said seal in said groove being of sufficient cross section to protrude slightly beyond said outer diameter of said tubular section, a radially extending flange section immovably attached to the end of said tubular section opposite to said open end, said flange section extending radially both inwardly and outwardly from said tubular section, said flange section also having a rearward face and a forward face, said rearward face attaching to said end of tubular section, said forward face being directionally opposite to said rearward face, said forward face providing a surface for said elastomeric seal surrounding said ferrule to press and seal against, said radially extending flange also having a radially centered through hole, said through hole substantially aligned with the longitudinal center line of said tubular section allowing passage of fluid therethrough, (d) a pair of adjacent members each comprising a rigid structure rigidly affixed, internal passages for conveyance of fluid, at least one substantially flat external surface, a passage connecting to said internal passages and terminating upon said external surface, said external surface with said terminating external passage being spaced apart and substantially parallel with that of said adjacent member, said terminating end of said external passage of each said member being opposed and substantially aligned with each other, (e) said annular mounting rings each having an overall longitudinal length which is less than the distance between said spaced apart parallel surfaces of said adjacent members, thereby allowing easy installation of same between said members, (f) said open end of said tubular section of each said annular mounting ring placed into said external passage of each said opposing member thus providing positioning of said annular mounting rings, said circumferential elastomeric seal in said groove upon said tubular section forming a static seal between said annular mounting rings and each corresponding said member, (g) a clamping means circumferentially surrounding said elastomeric seal surrounding said ferrule for applying a clamping force thereon to expand the sidewalls thereof outwardly away from each other and into sealing contact with said forward surface of said radially extending flange section of each said annular mounting ring thereby forming a convenient, leak proof conduit between said members.

2. The seal assembly of claim 1 wherein sidewalls of said elastomeric seal surrounding said ferrule have a preformed circular shape in the form of a step, said circular shape corresponding to said forward face of said radially extending flange section of each said annular mounting ring, thereby providing for alignment of said seal with each said annular mounting ring.

3. The seal assembly of claim 1 wherein said forward face of said radially extending flange section of each said annular mounting ring has a preformed circular shape in the form of a step, to provide for alignment of each said annular mounting ring with said elastomeric seal with ferrule.

4. The seal assembly of claim 1 wherein sidewalls of said elastomeric seal with ferrule and said forward face of said radially extending flange of each said annular mounting ring have a substantially matching preformed circular shape in the form of a step, to provide for alignment of said annular mounting rings with said elastomeric seal with ferrule.

5. The seal assembly of claim 1 wherein said rearward face of said outwardly extending radial flange section of said annular mounting ring is in contact with said outer surface of said member thereby providing for control of installation depth of said tubular section into said member.

6. The seal assembly of claim 1 wherein said through hole of said radially extending flange section of said annular mounting ring may be made of various sizing during manufacture thereby providing a selective method of controlling fluid flow therethrough.

* * * * *